United States Patent [19]

Hendershott

[11] Patent Number: 4,917,382

[45] Date of Patent: Apr. 17, 1990

[54] INFLATABLE TOY ARTICLE

[76] Inventor: Philip A. Hendershott, Rt. 5, Box 19, Emporia, Kans. 66801

[21] Appl. No.: 147,521

[22] Filed: Jan. 25, 1988

[51] Int. Cl.[4] ..... A63B 59/06; A63H 27/10

[52] U.S. Cl. ..... 273/72 R; 446/220

[58] Field of Search ..... 446/220, 221, 222, 226; 273/72 R, 67 R, 84 R

[56] References Cited

U.S. PATENT DOCUMENTS

| | | | |
|---|---|---|---|
| 1,383,115 | 6/1921 | Hendry | 446/221 X |
| 1,549,790 | 8/1925 | Neusella | 446/220 |
| 1,558,200 | 10/1925 | Murphy | 446/226 X |
| 2,987,317 | 6/1961 | Acevedo | 273/67 R |
| 3,523,563 | 8/1970 | Mirando | 446/220 X |
| 4,307,537 | 12/1981 | Bergmann | 446/222 |

FOREIGN PATENT DOCUMENTS

| | | | |
|---|---|---|---|
| 1811748 | 6/1970 | Fed. Rep. of Germany | 446/220 |

*Primary Examiner*—Mickey Yu

*Attorney, Agent, or Firm*—Bill D. McCarthy

[57] ABSTRACT

An inflatable article, such as a toy, is provided with an outer protective cover constructable in various selected shapes such as a softball bat, the protective cover defining an interior balloon cavity and having an entry slot for access thereto. A toy balloon in its deflated state is inserted into the balloon cavity and inflated via the nozzle extensive from the entry slot to fill the balloon cavity. The nozzle of the toy balloon is sealed and tucked into the entry slot, and the entry slot is covered by a sealing element. A second bat embodiment is constructed having its handle portion separately constructed and attached to the cover by adhesive.

4 Claims, 2 Drawing Sheets

INFLATABLE TOY ARTICLE

BACKGROUND OF THE INVENTION

1. Field of the Invention.

The present invention relates generally to the field of toys, and more particularly but not by way of limitation, to an improved inflatable toy article having various shapes which is safe for small children and which is easily repairable.

2. Brief Description of the Prior Art.

For over an hundred years the sporting goods industry has been producing inflatable balls of various sizes and shapes such as footballs, basketballs, soccer balls, punching bags and the like. Most of these balls consist of an air tight inflatable bladder confined within an outer cover, the cover usually being constructed from a wear and abrasion resistant material. Commonly, the bladders in these balls are constructed of relatively thick rubber or other polymeric material, and the covers utilize leather or a leather-like plastic.

The bladders are usually inserted inside the outer cover during the manufacturing process, after which the cover is laced, sewn, or otherwise sealed, so as to make subsequent removal of the bladder for repair or replacement difficult or impossible. None of the prior art balls known to the present inventor has utilized an easily replaced or disposable bladder.

SUMMARY OF THE INVENTION

The present invention provides an improved line of inflatable toys utilizing simple, readily available materials that feature safety and facilitate repairability.

The shape of a toy constructed in accordance with the present invention is determined by the configuration of an outer protective cover which comprises one or more pieces of cloth or cloth-like material sewn or otherwise joined at seams to form a selected shape, such as a sphere, cube, rectangular solid, or other appropriate shape, the protective cover defining an interior balloon cavity.

A small entry slot, provided in an appropriate location in the protective cover, permits insertion of a deflated bladder, usually a toy balloon. Once inserted into the protective cover with the nozzle of the balloon bladder extensive from the entry slot, the balloon bladder is inflated and sealed; and the nozzle of the balloon bladder is tucked into the entry slot. The entry slot can be covered to further protect the tucked-in nozzle of the balloon bladder.

A primary object of the present invention is to provide an inflatable toy having a replaceable balloon bladder and which is capable of withstanding considerable abuse, such as at the hands of small children.

Another object of the present invention is to provide an inflatable toy which achieves the above stated object with minimum expense and which is easily repairable.

Other objects, advantages and features of the present invention will become clear from the following description of the preferred embodiment when read in conjunction with the accompanying drawings and appended claims.

BRIEF DESCRIPTION OF THE DRAWINGS

FIG. 6A is a view of a slot cover which is affixed to the soft baseball bat of FIG. 5.

DESCRIPTION

Figure 1:
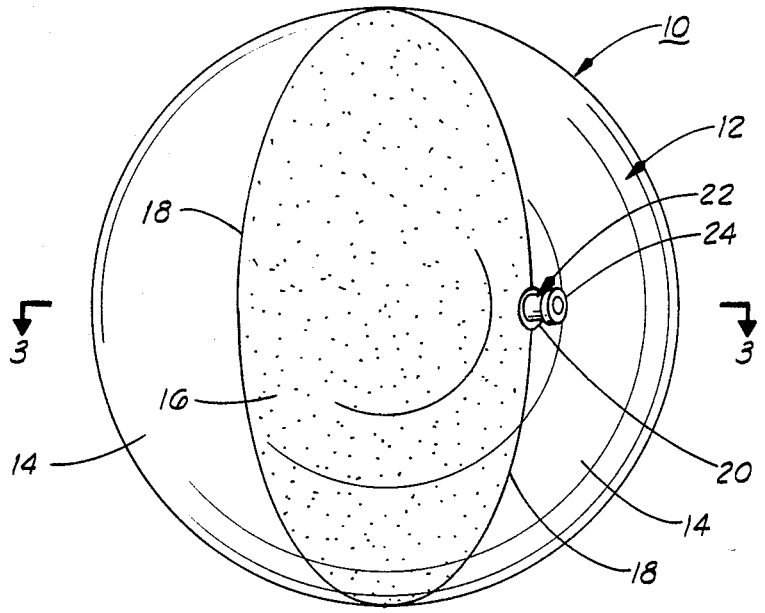
FIG. 1 is an elevational view of a balloon ball constructed in accordance with the present invention.

Referring now to the drawings, like numerals and characters designate like elements throughout the figures of the drawings.

Figure 2:
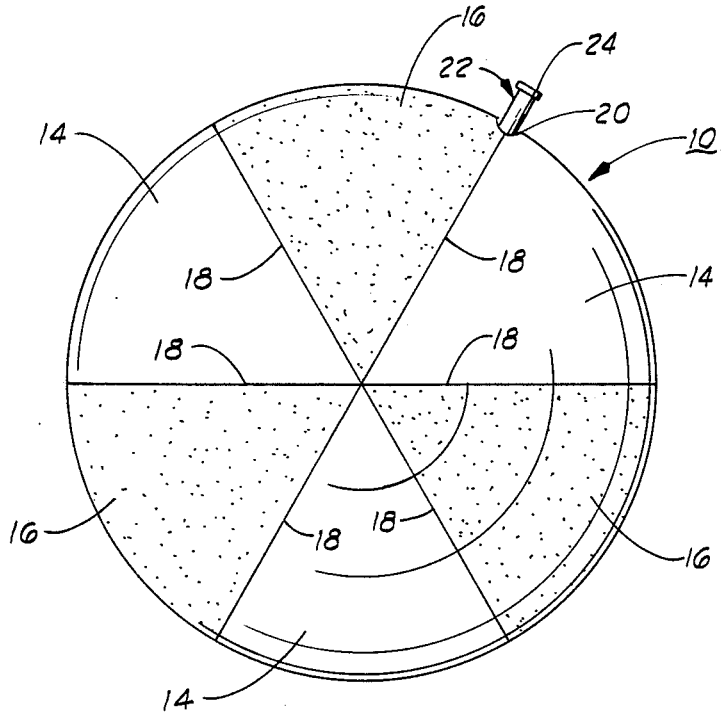
FIG. 2 is a plan view of the balloon ball of FIG. 1.
Figure 3:
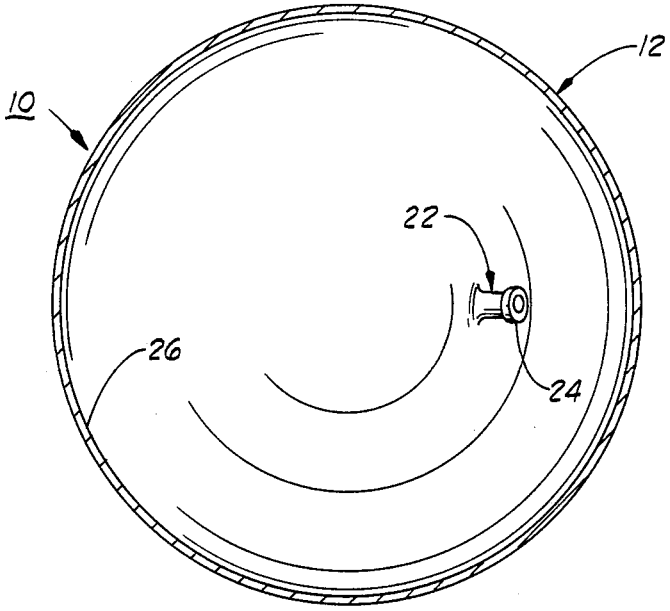
FIG. 3 is a view taken at 3—3 in FIG. 1.

An inflatable toy article constructed in accordance with the present invention is depicted in FIGS. 1, 2 and 3 and is designated by the numeral 10. The inflatable toy 10 is in the form of a balloon ball and comprises an outer protective cover 12 preferably constructed of one or more appropriately contoured pieces of a pliable material members 14 and 16 to define an interior balloon cavity; and if desired, the outer protective cover 12 can be constructed of a soft cloth or cloth-like material which can be washable. By way of example, nylon cloth, cotton cloth and pliable plastic are three common materials which can be used to construct the protective cover 12. The number and shape of individual pieces 14 and 16 required will depend upon the ultimate shape of the desired end product.

The pliable material members 14 and 16 are joined at seam portions 18 such as by sewing with needle and elongated binding element such as a thread member to achieve the shape of a sphere. An entry slot 20 is provided, preferably along one of the seams 18, for access to the balloon cavity. The entry slot 20 is of sufficient size to permit the insertion of a deflated balloon bladder 22 which has a nozzle portion 24 and an inflatable body portion 26. The balloon bladder 22, once inserted into the protective cover 12, is inflated, sealed, and the nozzle portion 24 is tucked into entry slot 20 so as to present a smooth outer contour of the sphere.

One feature of the present invention is that the balloon bladder 22 is a toy balloon of the type commonly available in most retail establishments that sell toys, novelties and the like. Such toy balloons are constructed of a thin elastomeric material and are very inexpensive. Conventional balloons of this type are widely given to small children because they are easily inflated without any inflating equipment. Once blown into their inflated shapes by mouth and forced exhalation, the balloons can be used in a variety of ways for entertaining small children. However, the balloons are easily burst, often on purpose, due to the extremely thin membrane wall of such, and accidental intake of fragments of a bursted balloon is known to be a severe safety hazard to small children. Without further mention, it will be understood that the balloon bladders of the below described embodiments are such conventionally available toy balloons.

Figure 4:
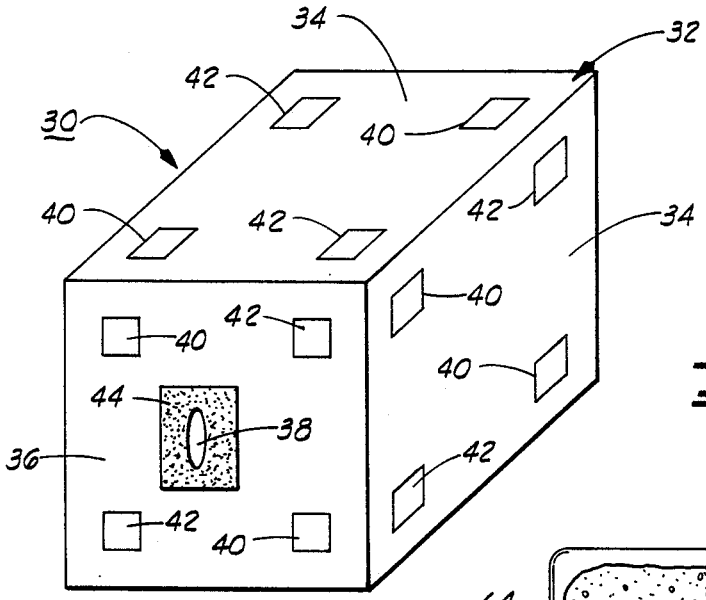
FIG. 4 is an isometric view of another embodiment of the present invention as a toy building block.

FIG. 4 depicts an embodiment of the inflatable toy of the present invention in the form of a toy building block 30. The building block 30 comprises an outer protective cover 32 which is formed of four rectangular side members 34 and two square end members 36 to define an interior balloon cavity. The side and end members 34, 36 are preferably constructed of flexible material such as those earlier mentioned for the inflatable toy 10, and are joined at their respective edges by binding elements to form a soft rectangular solid when internally supported. In like manner, a toy building block in the shape of a cube (not shown) can be constructed by using appropriately dimensioned pliable members. For clarity, the interior balloon bladder of the building block 30 is omitted in FIG. 4 to show an entry slot 38 provided in one of the end members 36 through which the balloon bladder can be inserted, inflated, sealed and tucked inside the protective cover 32 in the manner described hereinabove for the balloon bladder 22 of the inflatable toy 10.

The inflatable toy building block 30 is preferably provided with a plurality of small fastener elements 40 and 42 affixed to each side member 34 of the protective cover 32 in a regularly spaced pattern as shown. Preferably, the fastener elements 40, 42 are of the type wherein two interlocking elements are used, one element having a loop bearing area (male) and the other having a pile bearing area (female), the loops interlocking with the pile when disposed in close contact. A commercial version of such interlocking male and female element fasteners is available under the trademark Velcro. The fastener elements 40, 42 are attached, such as by an adhesive or a binding element, to the side and end members 34, 36, and are selectively alternated so as to make each building block 30 attachable on all sides to another similarly constructed building block 30 which is positioned to align and interconnect the spatially disposed male and female Velcro fastener members 40, 42.

Figure 4A:
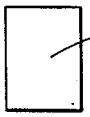
FIG. 4A is a view of a slot cover which is affixed to the toy building block of FIG. 4.

A further enhancement to the building block 30 is provided by the attachment of a first sealing element 44 to the area immediately surrounding the entry slot 38. A second sealing element 46 of substantially the same size (shown in FIG. 4A) is provided to cover the entry slot 38 after the balloon bladder has been inserted, inflated, sealed and its nozzle tucked inside the protective cover 32. Preferably, the first and second sealing elements 44, 46 are appropriately sized strips of Velcro with the first sealing element 44 being a female Velcro strip and the second sealing element 46 being a male Velcro strip. When joined, the first and second sealing elements 44, 46 provide a smooth surface on that portion of the building block 30.

Figure 5:
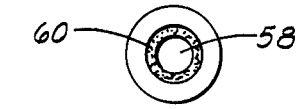
FIG. 5 is a partially cutaway, side elevational view of yet another embodiment of the present invention as a soft baseball bat.
Figure 5A:
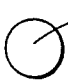

Another embodiment of the inflatable toy of the present invention is depicted in FIG. 5 in the form of a soft baseball bat 50. The baseball bat 50 has an outer protective cover 52 constructed of a plurality of pieces of pliable material, such as nylon cloth, which are sewn or otherwise joined together at appropriate seams so as to form a generally elongated cylindrical shape having an interior balloon cavity. The protective cover 52 is shaped to have a larger diameter in a ball striking portion 54 and a smaller diameter of convenient size for grasping with the hand in a handle portion 56. An entry slot 58 is provided in the end of the handle portion 56 through which the deflated balloon bladder (not shown) can be inserted. Once inserted into the balloon cavity, the balloon bladder can be inflated, sealed, and its nozzle tucked inside the protective cover 52.

Figure 6:
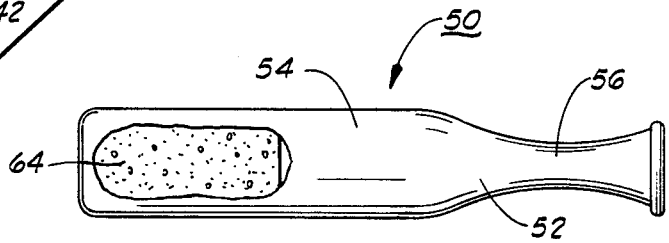
FIG. 6 is an end view of the soft baseball bat of FIG. 5.

An enhancement to this embodiment of the present invention is depicted in FIGS. 6 and 6A. A female Velcro fastener element 60 is attached to the protective cover 52 in the area immediately surrounding the entry slot 58. A matching male Velcro fastener element 62 (FIG. 6A) of substantially the same size as the fastener element 60 can then be attached to cover the entry slot 58 after the bladder is inserted, inflated, sealed, and the nozzle of the balloon bladder tucked inside the protective cover 52.

A further enhancement of the soft baseball bat 50 comprises the placement of a semi-rigid plug member 64 inside the ball striking portion 54 of the protective cover 52. The plug member 64 can be a cylindrically shaped member of a sponge like material, such as a foamed rubber or plastic, which is affixed to the inside surface of the protective cover by an appropriate adhesive. The increased mass provided to the soft baseball bat 50 by the plug member 64 improves the feel and efficiency of the bat by imparting greater energy to a ball upon impact with the ball striking portion 54.

Figure 7:
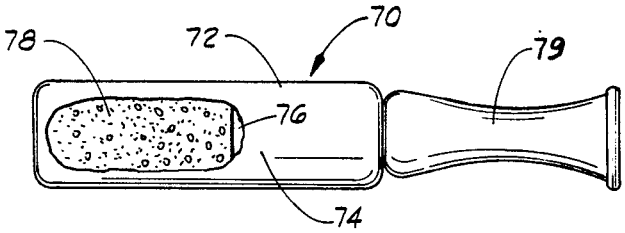
FIG. 7 is a partially cutaway, side elevational view of yet another embodiment as a soft baseball bat.

Yet another embodiment of the inflatable toy of the present invention is shown in FIG. 7 in the form of a soft baseball bat 70. The baseball bat 70 has an outer protective cover 72 constructed of a plurality of pieces of pliable material as required to form a generally elongated cylindrically shaped ball striking portion 74 having an interior balloon cavity. An entry slot (not shown) is provided, as described above for the other embodiments, for insertion of a balloon bladder 76 which, upon insertion into the balloon cavity of the protective cover 72, can be inflated and sealed. A semi-rigid plug member 78, similar in construction and design as the plug member 64 of the baseball bat 50 of FIG. 5, is disposed in the balloon cavity and adhesively bonded to the inside surface of the protective cover 72 at one end thereof.

An appropriately shaped handle member 79 is attached to the distal end of the protective cover 72 by a conventional adhesive. The handle member 79 is constructed of a lightweight material, such as a molded plastic, and can be hollow to preserve material.

As is clear from the above descriptions of the embodiments shown in the drawings, the present invention provides an expensive and safe inflatable toy comprising an outer protective cover defining an interior balloon cavity. A conventionally available toy balloon is inserted in its deflated state into the balloon cavity via a small entry slot conveniently provided in the protective cover. The nozzle of the balloon is caused to extend from the entry slot and serves to permit the balloon to be inflated. The protective cover protects the balloon to prolong its usefulness as a toy, and should the balloon burst, the protective cover confines the balloon and prevents potential harm from the fragments thereof. The inflatable toy is easily repairable by simply removing the ruptured balloon from the balloon cavity via the entry slot and replacing same with another toy balloon in the manner described.

It is clear that the present invention is well adapted to carry out the objects and to attain the ends and advantages mentioned herein as well as those inherent in the invention. While presently preferred embodiments of the invention have been described for purposes of this disclosure, it will be appreciated that the present invention is well adapted to serve in many toy and decorative purposes, and it is therefore not limited by the embodiments selected for illustrative purposes herein. It will of course be appreciated that numerous changes can be made which will readily suggest themselves to those skilled in the art and which are accomplished within the spirit of the invention disclosed and as defined in the appended claims.

What is claimed is:

1. An inflatable toy comprising:

an outer protective cover having a selected shape and defining an interior balloon cavity, the selected shape of the protective cover being in the form of a softball bat and having the shape of an elongated cylinder with a handle portion having a diameter of convenient size for grasping and a ball striking portion with a somewhat larger diameter, the protective cover fabricated of a plurality of pliable members constructed to have appropriate contours, the pliable members being joined together along the edges thereof to produce the selected shape of the inflatable toy and to define an entry slot which openly communicates with the balloon cavity;

plug means disposed in a portion of the balloon cavity defining the ball striking portion for imparting greater mass to the ball striking portion;

a toy balloon fabricated of a thin, air tight, inflatable membrane having a body portion and a nozzle portion such that in a deflated state the body portion is disposable within the balloon cavity and the nozzle portion is extendable from the entry slot so that the body portion is inflatable to selectively fill the balloon cavity and support the outer protective cover in the selected shape; and cover means for covering the entry slot after insertion and inflation of the body portion, sealing of the nozzle portion and positioning the sealed nozzle portion into the entry slot, the cover means comprising:

a first fastener member having a loop bearing area and a second fastener member having a pile bearing area, the first fastener member affixed to the protective cover around the entry slot, the second fastener member having a suitable size to cover the entry slot when supported by the first fastener member.

2. The inflatable toy of claim 1 wherein the plug means comprises a plug member constructed of a semi-rigid material and adhesively bonded to the inside surface of the protective cover.

3. An inflatable toy comprising:

an outer protective cover in the form of an elongated cylinder portion defining an interior balloon cavity having a ball striking portion, the protective cover fabricated of a plurality of pliable members constructed to have appropriate contours, the pliable members being joined together along the edges thereof to produce the elongated cylinder portion of the inflatable toy and to define an entry slot which openly communicates with the balloon cavity;

a handle member attached to one end of the elongated cylinder portion;

plug means disposed in a portion of the balloon cavity for imparting greater mass to the ball striking portion;

a toy balloon fabricated of a thin, air tight, inflatable membrane having a body portion and a nozzle portion such that in a deflated state the body portion is disposable within the balloon cavity and the nozzle portion is extendable from the entry slot so that the body portion is inflatable to selectively fill the balloon cavity and support the outer protective cover in the selected shape; and cover means for covering the entry slot after insertion and inflation of the body portion, sealing of the nozzle portion and positioning the sealed nozzle portion into the entry slot.

4. The inflatable toy of claim 3 wherein the plug means comprises a plug member constructed of a semi-rigid material and adhesively bonded to the inside surface of the protective cover.

* * * * *

UNITED STATES PATENT AND TRADEMARK OFFICE

CERTIFICATE OF CORRECTION

PATENT NO. : 4,917,382

DATED : April 17, 1990

INVENTOR(S) : Philip A. Hendershott

It is certified that error appears in the above-identified patent and that said Letters Patent is hereby corrected as shown below:

Column 4, line 42, delete "expensive" and substitute --inexpensive-- therefor.

Signed and Sealed this

Second Day of July, 1991

*Attest:*

HARRY F. MANBECK, JR.

*Attesting Officer*

*Commissioner of Patents and Trademarks*